US007580024B2

(12) United States Patent
Kamimura

(10) Patent No.: US 7,580,024 B2
(45) Date of Patent: Aug. 25, 2009

(54) DISPLAY APPARATUS AND METHOD OF CONTROLLING THE BACKLIGHT PROVIDED IN THE DISPLAY APPARATUS

(75) Inventor: Shigeki Kamimura, Tsurugashima (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 573 days.

(21) Appl. No.: 11/426,715

(22) Filed: Jun. 27, 2006

(65) Prior Publication Data

US 2007/0024573 A1 Feb. 1, 2007

(30) Foreign Application Priority Data

Jul. 27, 2005 (JP) ..... 2005-217775

(51) Int. Cl.
*G09G 5/00* (2006.01)

(52) U.S. Cl. ..... 345/102

(58) Field of Classification Search ..... 345/102
See application file for complete search history.

(56) References Cited

U.S. PATENT DOCUMENTS

| | | | | |
|---|---|---|---|---|
| 5,592,193 | A * | 1/1997 | Chen | 345/102 |
| 6,429,839 | B1 * | 8/2002 | Sakamoto | 345/87 |
| 6,756,954 | B2 * | 6/2004 | Yamamoto et al. | 345/87 |
| 7,277,079 | B2 * | 10/2007 | Kobayashi et al. | 345/102 |
| 7,382,350 | B2 * | 6/2008 | Huang et al. | 345/102 |
| 7,414,608 | B2 * | 8/2008 | Funamoto et al. | 345/102 |
| 7,450,104 | B2 * | 11/2008 | Baik | 345/102 |
| 7,460,103 | B2 * | 12/2008 | Konno et al. | 345/102 |
| 7,466,301 | B2 * | 12/2008 | Sohn et al. | 345/102 |
| 2003/0146919 | A1 | 8/2003 | Kawashima et al. | |
| 2003/0222884 | A1 | 12/2003 | Ikeda et al. | |
| 2004/0227456 | A1 | 11/2004 | Matsui | |
| 2005/0104841 | A1 * | 5/2005 | Sohn et al. | 345/102 |
| 2005/0179637 | A1 * | 8/2005 | Iisaka | 345/102 |
| 2005/0231457 | A1 * | 10/2005 | Yamamoto et al. | 345/102 |
| 2006/0001641 | A1 * | 1/2006 | Degwekar et al. | 345/102 |
| 2006/0007112 | A1 * | 1/2006 | Park | 345/102 |

FOREIGN PATENT DOCUMENTS

| | | |
|---|---|---|
| JP | 11-65531 | 3/1999 |
| JP | 2002-372733 | 12/2002 |
| JP | WO 2003-075257 | 9/2003 |
| JP | 2004-110050 | 4/2004 |
| JP | 2005-79994 | 3/2005 |
| JP | 2005-148709 | 6/2005 |

* cited by examiner

*Primary Examiner*—Richard Hjerpe
*Assistant Examiner*—Nelson Lam
(74) *Attorney, Agent, or Firm*—Oblon, Spivak, McClelland, Maier & Neustadt, P.C.

(57) ABSTRACT

According to one embodiment, a display apparatus including a receiving unit, two signal processing units and, a luminance-curve converter, a display device, a histogram-extracting unit, and a characteristic-control-data output unit. The unit sets a characteristic to the luminance-curve converter in accordance with histogram distribution data. The display apparatus further comprises a first control-signal generating unit, a second control-signal generating unit and a selector. The unit generates a first control signal that reduces amount of light emitted from the backlight to a value corresponding to the value obtained by integrating the data for emphasizing the low-region, in the luminance-curve converter. The unit determines darkness of the image from the histogram distribution data and generates a second control signal that reduces amount of light in accordance with the darkness of the image. The selector outputs one of the control signals output from two control-signal generating units, which reduces amount of light.

11 Claims, 10 Drawing Sheets

DISPLAY APPARATUS AND METHOD OF CONTROLLING THE BACKLIGHT PROVIDED IN THE DISPLAY APPARATUS

CROSS-REFERENCE TO RELATED APPLICATIONS

This application is based upon and claims the benefit of priority from Japanese Patent Application No. 2005-217775, filed Jul. 27, 2005, the entire contents of which are incorporated herein by reference.

BACKGROUND

1. Field

One embodiment of the invention relates to a display apparatus and a device and method for controlling the backlight provided in the display apparatus. More particularly, one embodiment of the invention relates to a display apparatus that can impart enhanced gradation to dark images, particularly at low power consumption, and can display high-quality images at low power consumption.

2. Description of the Related Art

As is known, digital television broadcasting has been promoted in recent years. In Japan, for example, not only satellite digital broadcasting systems, such as broadcasting-satellite (BS) digital broadcasting and 110-communications satellite (CS) digital broadcasting, but also the ground digital broadcasting has come into service.

TV broadcast receivers of a new type have come into use. They incorporate a record/playback device that automatically records any broadcast program that accords with the genre and keyword the user has input. When the user selects any broadcast program thus recorded, the record/playback device plays back the broadcast program.

The record/playback device needs to have a storage capacity large enough to record a number of broadcast programs. It also needs to access and retrieve any recorded program selected, as fast as possible. In view of this, a hard disk drive (HDD) is used as record/playback device.

The digital television broadcast receivers recently provided have a large display device and can be connected to various peripheral devices. In addition, they are connected, in increasing numbers, to networks. To improve the quality of images the display device may display, techniques have been developed, which adjust not only video signals, but also the amount of light the backlight emits.

To adjust the amount of light, the power-supply voltage of the backlight may be changed. When the power-supply voltage is changed, the image displayed may be degraded. Particularly in a large liquid crystal display, changes in the power-supply voltage of the backlight greatly influence the image gradation. It is therefore required that the power-supply voltage should be carefully controlled.

Jpn. Pat. Appln. KOAKI Publications 2004-110050 and 2005-148709 disclose the technique of controlling the voltage of a backlight in accordance with the characteristics of the video signals supplied to the display device that incorporates the backlight.

The technique disclosed in Jpn. Pat. Appln. KOAKI Publication 2004-110050 lies in using is to use the average picture level (APL) and the measured histogram distribution. First, a luminance-level region, e.g., a dark region, is designated and measured. Then, it is determined whether the histogram distribution measured exceeds the threshold value for the luminance-level region designated. If the histogram distribution does, the region is regarded as a dark region, regardless of the APL determined.

The technique disclosed in Jpn. Pat. Appln. KOAKI Publication 2005-148709 resides in measuring the histogram distribution from a video signal. The most frequent value F, i.e., the gradation existing more frequently in one image frame than any other gradation, is obtained from the distribution. In the backlight control unit, a plurality of regions have been set for gradations 0 to 255, each defined by eight bits. Those of the regions, which are pertinent to the value F, are examined. The backlight control unit outputs the control data set for the regions pertinent to the value F. The control data controls the amount of light the backlight emits.

In the conventional techniques, the regions for which the histogram distribution measured is applied are limited to those that have specific luminance levels. Further, the average picture level and the histogram distribution measured are used in combination to control the backlight.

In the conventional image display devices, however, sufficient measures are not taken to reduce power consumption. If data representing the average picture level is used, the display screen may be frequently controlled brightness. In such a case, the image displayed will degrade in quality.

BRIEF DESCRIPTION OF THE SEVERAL VIEWS OF THE DRAWINGS

A general architecture that implements the various feature of the invention will now be described with reference to the drawings. The drawings and the associated descriptions are provided to illustrate embodiments of the invention and not to limit the scope of the invention.

DETAILED DESCRIPTION

Various embodiments according to the invention will be described hereinafter with reference to the accompanying drawings. In general, according to one embodiment of the invention, a display apparatus including a receiving unit, two signal processing units and, a luminance-curve converter, a display device, a histogram-extracting unit, and a characteristic-control-data output unit. The unit sets a characteristic to the luminance-curve converter in accordance with histogram distribution data. The display apparatus further comprises a first control-signal generating unit, a second control-signal generating unit and a selector. The unit generates a first control signal that reduces the amount of light emitted from the backlight to a value corresponding to the value obtained by integrating the data for emphasizing the low-region, in the luminance-curve converter. The unit determines darkness of the image from the histogram distribution data and generates a second control signal that reduces the amount of light emitted from the backlight in accordance with the darkness of the image. The selector outputs one of the control signals output from the first and second control-signal generating units, which reduces the amount of light emitted from the backlight.

Figure 1:
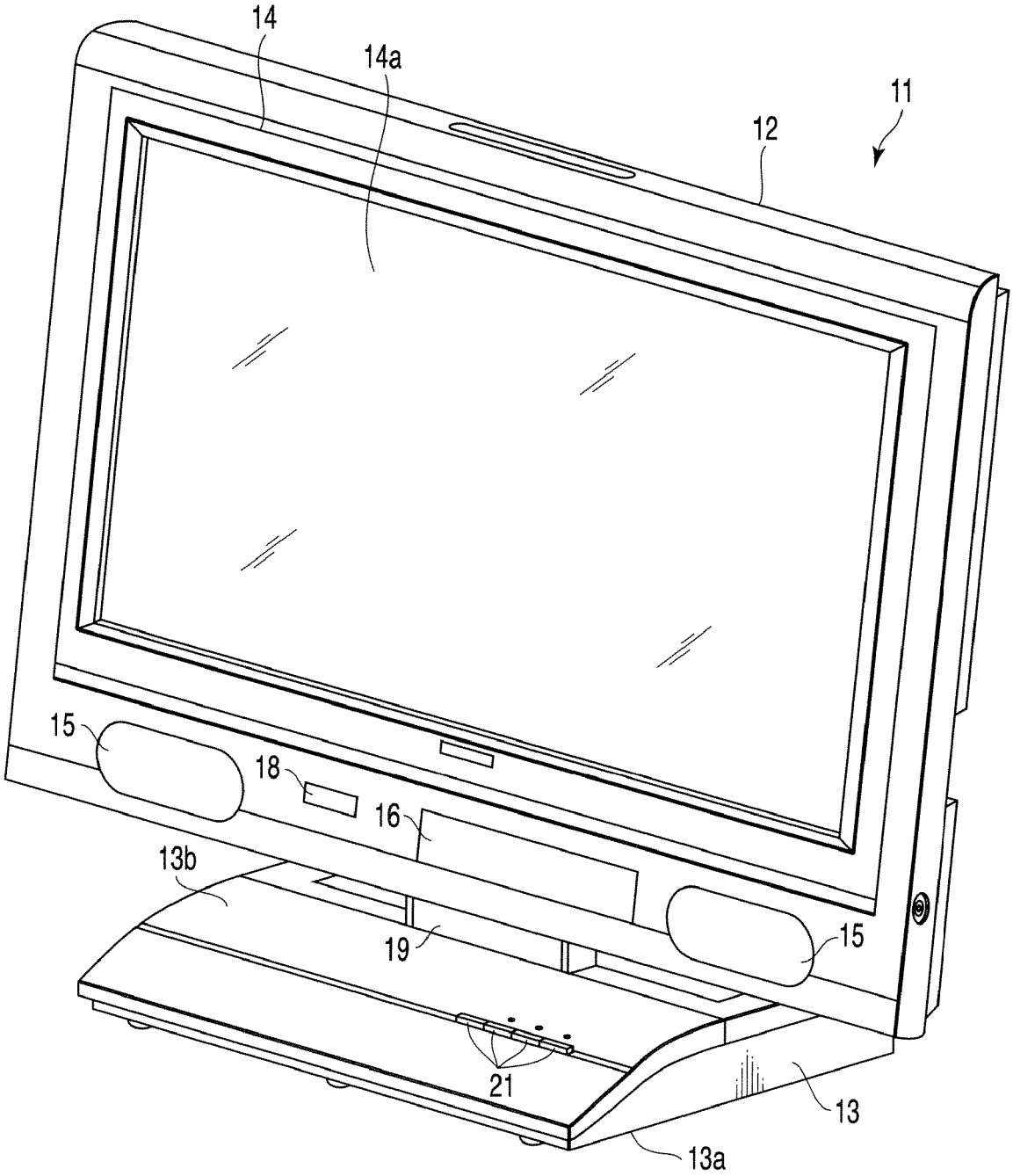
FIG. 1 is an exemplary perspective view showing the front of a television broadcast receiver that is an embodiment of this invention.

FIG. 1 is an exemplary perspective view showing the front of a television broadcast receiver 11 that is an embodiment of this invention. As FIG. 1 shows, the receiver 11 comprises a cabinet 12 and a stand 13. The cabinet 12 is the main unit of the receiver 11, which is thin and rectangular. The stand 13 supports and holds the cabinet 12 in standing position.

The display screen 14*a* of a display 14 is exposed at the front of the cabinet 12. The display 14 comprises, for example, a flat liquid crystal panel. A pair of speakers 15, an operation unit 16, and a light-receiving unit 18 are arranged on the front of the cabinet 12. The light-receiving unit 18 is configured to receive operation data from a remote controller 17 (not shown in FIG. 1).

The stand 13 is shaped like a thin box. It is configured to be mounted on a horizontal flat base (not shown), with its bottom plate 13*a* contacting the flat base. The stand 13 has a support member 19 that protrudes upward from the center part of the top plate 13*b*, which opposes the bottom plate 13*a*. The support member 19 is coupled to the back of the cabinet 12. The stand 13 therefore holds the cabinet 12 in the standing position.

The stand 13 incorporates an HDD 20 (not shown in FIG. 1). Buttons 21 (four buttons in this embodiment) are arranged on that part of the top plate 13*b*, which lies in front of the cabinet 12. The buttons 21 may be depressed to set the HDD 20 to various operating modes, such as recording mode, playback mode and stop mode.

Figure 2:
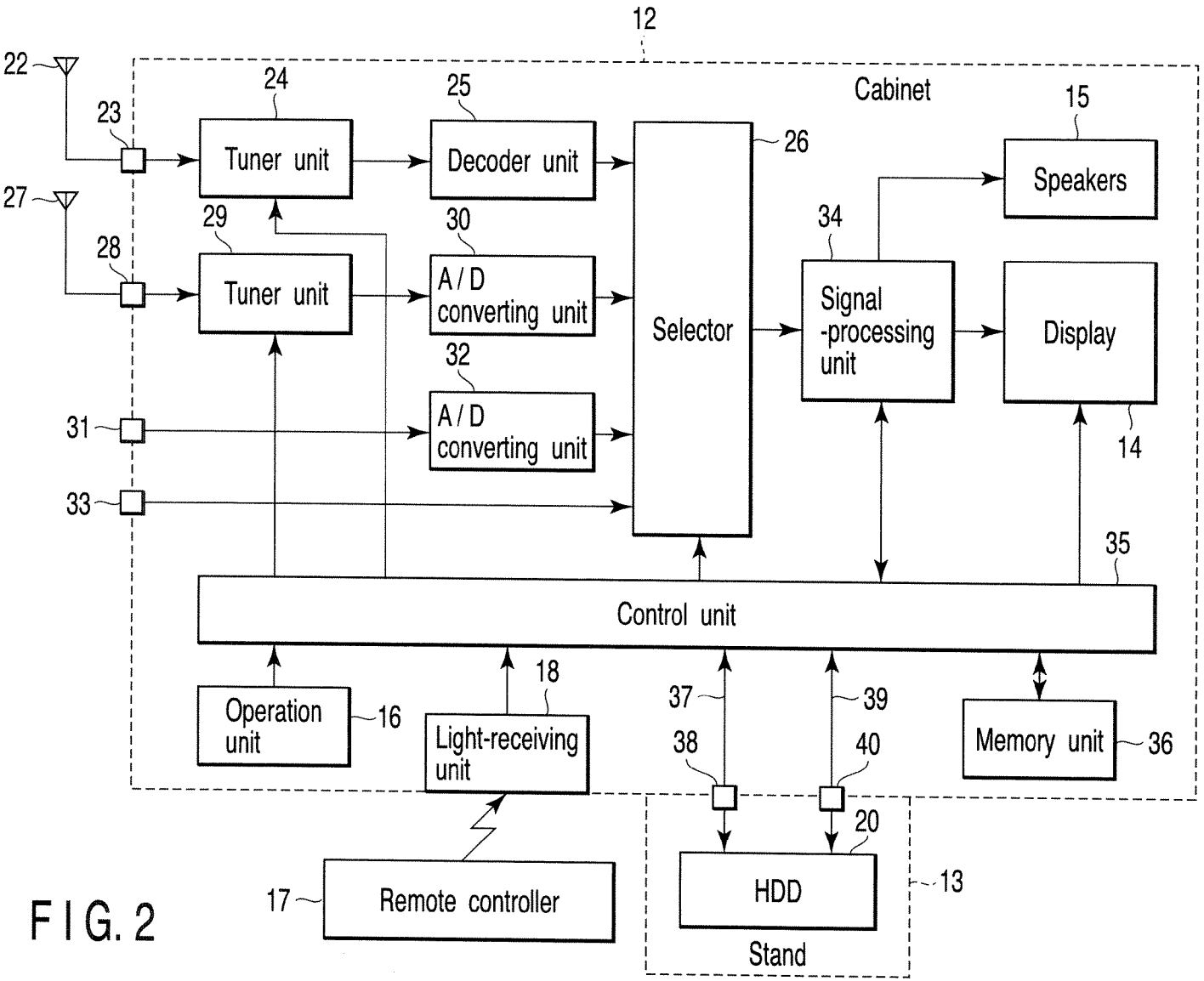
FIG. 2 is an exemplary block diagram of the signal-processing system incorporated in the television broadcast receiver in the embodiment.

FIG. 2 schematically shows the signal-processing system incorporated in the television broadcast receiver 11 in this embodiment. Most components of the signal-processing system are provided in the cabinet 12 and located near the back thereof. In other words, they are positioned at the back of the display screen 14*a* of the display 14.

An antenna 22 connected to the signal-processing system receives a digital television broadcast signal. The signal is supplied via an input terminal 23 to a tuner unit 24. The tuner unit 24 extracts a signal of a desired channel from the digital television broad signal input to it. The signal output from the tuner unit 24 is supplied to a decoder unit 25. The decoder unit 25 performs decoding, such as moving picture experts group 2 (MPEG2) decoding, on the signal input to it. The signal thus decoded is supplied to a selector 26.

The signal output from the tuner unit 24 is supplied directly to the selector 26. The selector 26 extracts video data and audio data from this signal. The video data and the audio data are supplied via a control unit 35 to the HDD 20. Thus, they can be recorded in the HDD 20.

Another antenna 27 is connected to the signal-processing system, too. This antenna 27 receives an analog television broadcast signal. This signal is supplied via an input terminal 28 to a tuner unit 29. This tuner unit 29 extracts a signal of the desired channel from the analog television broadcast signal and demodulates the same. The signal output from the tuner unit 29 is supplied to an analog-to-digital (A/D) converting unit 30. The A/D converting unit 30 converts the signal to a digital signal, which is output to the selector 26.

An analog video signal and an analog audio signal are supplied to an analog-signal input terminal 31 and thence to an A/D converting unit 32. The A/D converting unit 32 converts these signals to digital signals, which are supplied to the selector 26. Further, the analog video signal and the analogy audio signal are supplied to a digital-signal input terminal 33 and thence to the selector 26.

To record an A/D-converted signal in the HDD 20, the encoder incorporated in the selector 26 compresses the signal in a prescribed format such as MPEG2 format. Any A/D-converted signal, thus compressed, can be recorded in the HDD 20.

The selector 26 selects one of the four input digital video-audio signal, and supplies the selected video-audio signal to a signal-processing unit 34. The signal-processing unit 34 performs a specific process on the digital video signal contained in the video-audio signal. The digital video signal thus processed is supplied to the above-mentioned display 14. The image display 14 displays the image represented by the digital video signal. The display 14 is a flat panel display, such as a liquid crystal display. The signal-processing unit 34 performs a process on the digital audio signal contained in the video-audio signal, converting the signal to analog signals. The analog signals are supplied to the above-mentioned speakers 15, respectively. The speakers 15 generate sound from the analog signals, thus accomplishing audio playback.

In the television broadcast receiver 11, the control unit 35 controls various operations including the signal reception. The control unit 35 is a microprocessor that incorporates a central processing unit (CPU) and the like. The unit 35 receives the operation data from a remote controller 17 through the light-receiving unit 18. It controls some of the other components of the television broadcast receiver 11, in accordance with the operation data.

The control unit 35 uses a memory unit 36. The memory unit 36 comprises a read only memory (ROM), a random access memory (RAM), and a nonvolatile memory. The ROM stores the control programs the CPU executes. The RAM provides work areas for the CPU. The nonvolatile memory is provided to store various set data items, control data items and the like.

Note that the control unit 35 is connected to the HDD 22 that is provided in the stand 12. A line 37 is provided to supply power and control signals to the HDD 20. A connection unit 38 connects the line 37 to the control unit 35 and HDD 20.

A line 39 connects the control unit 35 and the HDD 20, for transferring digital video and audio signals between them. An i-Link connection unit 40 connects the line 39 to the control unit 35 and the HDD 20. Hence, digital video signals and digital audio signals are transferred between the control unit 35 and the HDD 20 by an i-Link (trademark), independently of the power and the control signals.

Any digital video signal and any audio signal that the selector 26 has selected in the television broadcast receiver 11 can therefore be recorded in the HDD 20. Moreover, the television broadcast receiver 11 can playback the digital video signal and the digital audio signal. Thus, the user can enjoy seeing the images represented by the video signal and listening to the sound represented by the audio signal.

Figure 3:
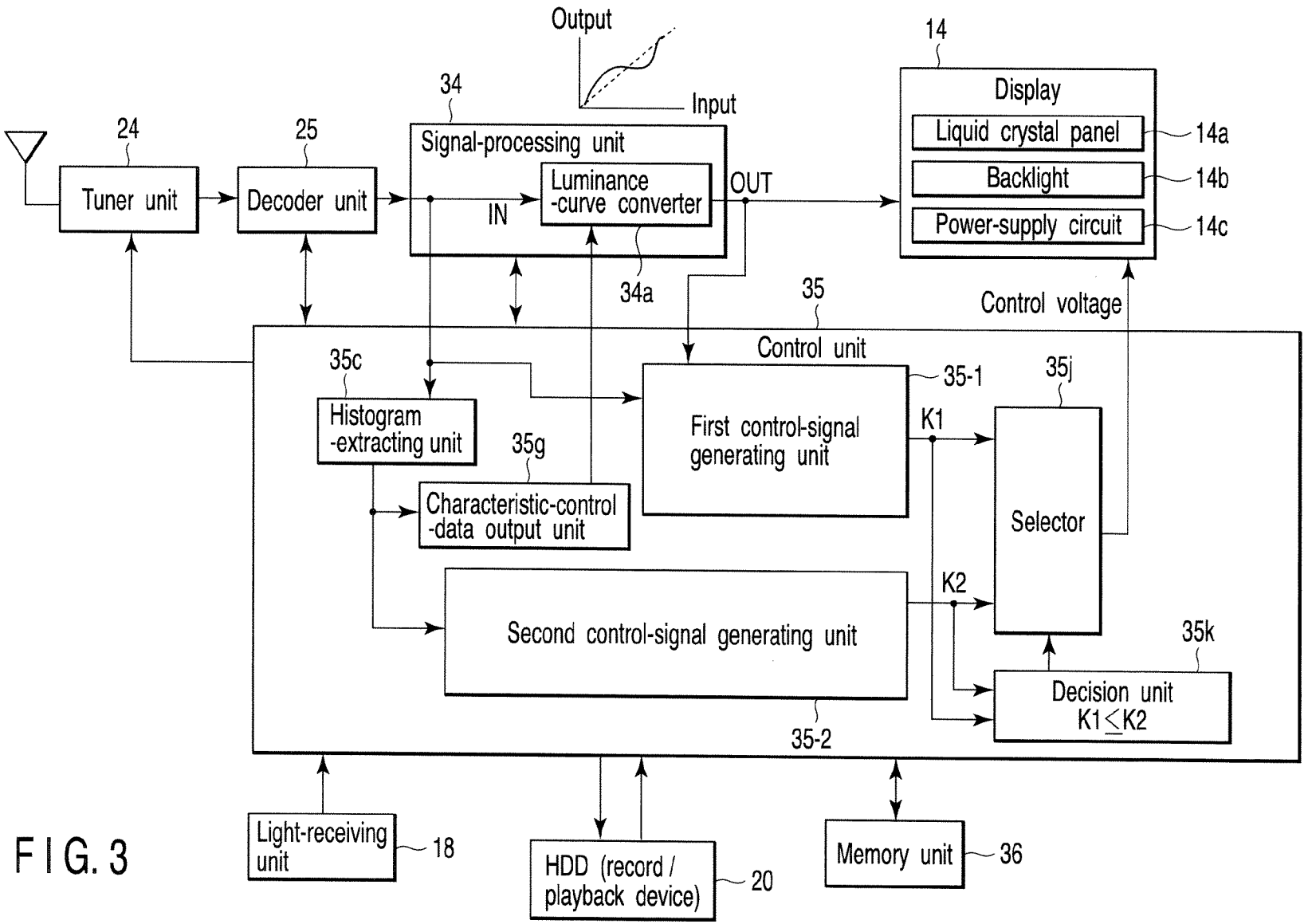
FIG. 3 is an exemplary block diagram depicting the major components of the receiver, which are characterizing features of the embodiment of this invention.

FIG. 3 shows the major components of the receive 11, which are characterizing features of this embodiment of the invention. The signal-processing unit 34 incorporates a luminance-curve converter 34*a* that converts the input/output characteristic of the luminance level of an input video signal. The operating characteristic of the luminance-curve converter 34*a* is set by the control data supplied from a characteristic-control-data output unit 35*g*, which will be described later.

The control unit 35 has a histogram-extracting unit 35*c* and the characteristic-control-data output unit 35*g*. The histogram-extracting unit 35*c* generates histogram distribution data about the luminance level of a video signal input to the luminance-curve converter 34*a*. The characteristic-control-data output unit 35*g* sets such a characteristic to the luminance-curve converter 34*a* that the luminance level of the image represented by the input video signal is raised if it is low.

The control unit 35 further has a first control-signal generating unit 35-1 and a second control-signal generating unit 35-2. The first control-signal generating unit 35-1 generates a control signal that reduces the amount of light emitted from a backlight 14*b* (shown in FIG. 4). The control signal is a value obtained by integrating the controlling part of the low-region data output from the luminance-curve converter 34*a*. The second control-signal generating unit 35-2 determines the brightness of the entire screen from the histogram distribution, and generates a control signal. This control signal reduces the amount of light emitted from the backlight in accordance with the darkness of the screen.

The control unit 35 further has a selector 35*j*. The selector 35*j* selects the control signal output from the first control-signal generating unit 35-1 or the control signal output from the second control-signal generating unit 35-2, which reduces the amount of light emitted from the backlight 14*b*. The selector 35*j* selects and outputs, for example, the control signal of greater value than the other.

The histogram-extracting unit 35*c* will be described. This unit 35*c* generates a histogram distribution of the luminance level of the video signal output from the signal-processing unit 34 (i.e., the luminance level of the video signal input to the luminance-curve converter 34*a*). At this time, the memory unit 36 stores one frame (or one field) of the video signal. Using the frame (or field) stored in the memory unit 36, the histogram-extracting unit 35*c* extracts histogram distribution data. The histogram distribution data thus extracted is input to the characteristic-control-data output unit 35*g*. The unit 35*g* generates characteristic control data, which is supplied to the characteristic control unit provided in the luminance-curve converter 34*a*. The luminance-curve characteristic may be set in units of one frame (one field) or in units of several frames (or several fields).

Figure 4:
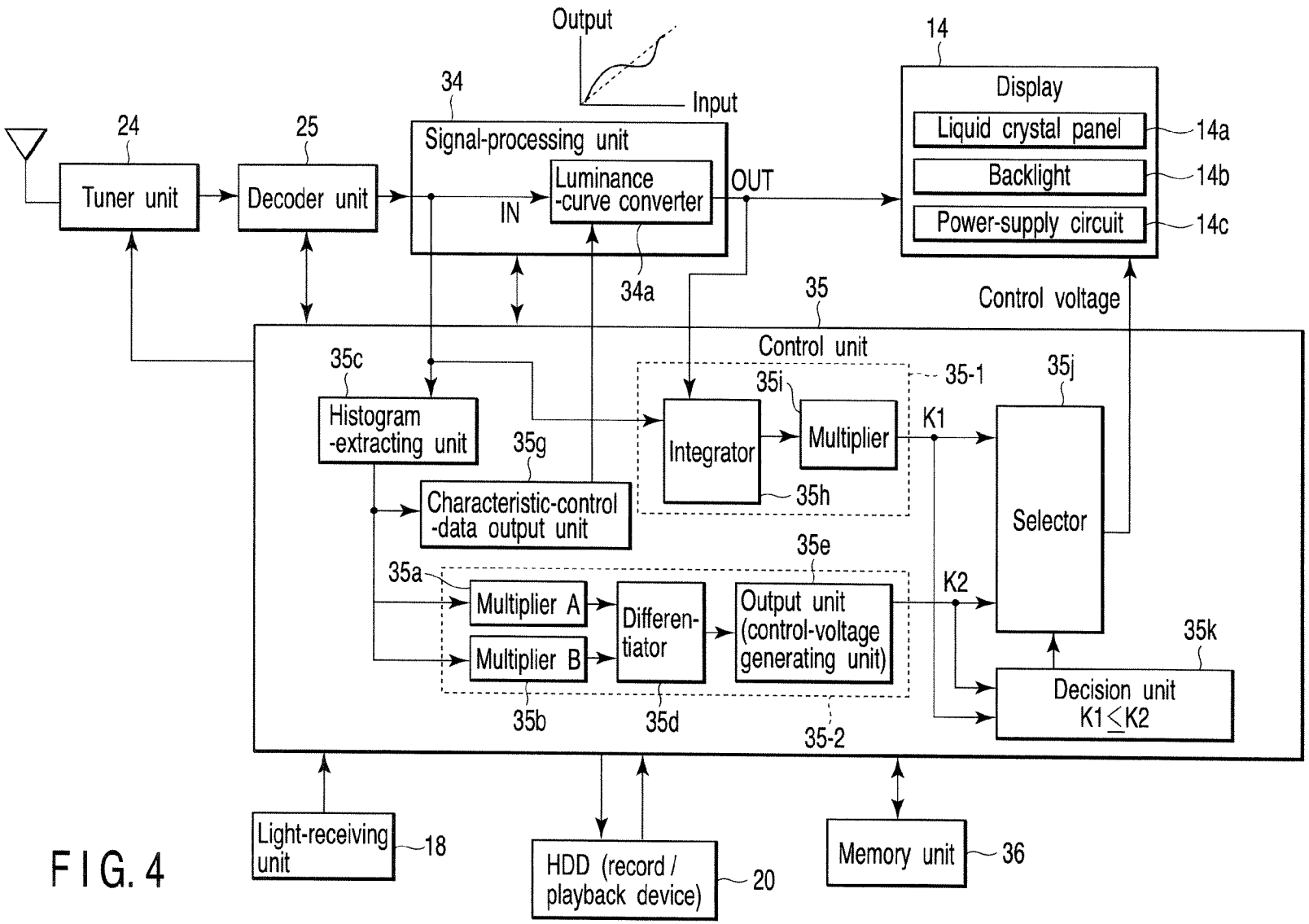
FIG. 4 is an exemplary block diagram illustrating, in detail, some of the components shown in FIG. 3.

FIG. 4 illustrates, in detail, the first control-signal generating unit 35-1 and the second control-signal generating unit 35-2 in this embodiment, both shown in FIG. 3.

The first control-signal generating unit 35-1 includes an integrator 35*h* and a multiplier 35*i*. The integrator 35*h* receives two luminance signals respectively at the input and output of the luminance-curve converter 34*a*. The integrator 35*h* integrates the emphasized data in the low-luminance region (dark region) data output from the luminance-curve converter 34*a*. If the data input to the converter 34*a* is at a higher-level than the data output from the converter 34*a*, the integrator 35*h* accumulates the difference between the data input to the converter 34*a* and the data output from the converter 34*a*. The data accumulated is input to the multiplier 35*i*. The multiplier 35*i* multiplies the data by a coefficient for each frame (or each field), generating a control voltage. The control voltage is input to the selector 35*j*.

The second control-signal generating unit 35-2 includes two multipliers 35*a* and 35*b*, a differentiator 35*d*, and an output unit 35*e*. The first multiplier (35*a*) which multiplies the histogram distribution data (i.e., luminance-level distribution data) output from the histogram-extracting unit 35*c*, with first multiplying values distributed in descending order as the luminance level increases. Thus, the first multiplier 35*a* provides a product of the histogram distribution and the multiplying values. The second multiplier 35*b* which multiplies the histogram distribution data (i.e., luminance-level distribution data) output from the histogram-extracting unit 35*c*, with second multiplying values distributed in ascending order as the luminance level increases. Thus, the second multiplier 35*b* provides a product of the histogram distribution and these multiplying values. The differentiator 35*d* finds the difference between the outputs of the first and second multipliers 35*a* and 35*b* and generates control data in accordance with the magnitude ratio of the output from the first multiplier 35*a* to the difference. The control data is input to the output unit 35*e*. The output unit 35*e* generates a control voltage from the control data. The control voltage is applied to the selector 35*j*. The selector 35*j* applies the control voltage to the display 14. In the display 14, the control voltage is applied to a power-supply circuit 14*c* and thence to a backlight 14*b*.

The display 14 has the backlight 14*b* and the power-supply circuit 14*c*. The back light 14*b* is provided in the back of the liquid crystal panel 14*a*. The power-supply circuit 14 drives the backlight 14*b*. The control voltage (i.e., light-controlling voltage) generated by the output unit 35*e* of the control unit 35 is applied to the power-supply circuit 14*c*. The control voltage can adjust the luminance of the backlight 14*b*.

The outputs K1 and K2 (control signals) of the first and second control-signal generating units 35-1 and 35-2 are input to a decision unit 35K. The decision unit 35*k* determines which control signal, K1 or K2, will render the screen darker than the other. The control signal found to make the screen darker is supplied to the selector 35*j*, controlling the selector 35*j*. That is, one of the control signals K1 and K2, which makes the screen darker than the other, is used as a signal that controls the amount of light emitted from the back light 14*b*.

The characteristics of the control signal K1 and K2 generated by the first and second control-signal generating units 35-1 and 35-2, respectively, will be described.

(Characteristic of the Control Signal K1)

Figure 5A:
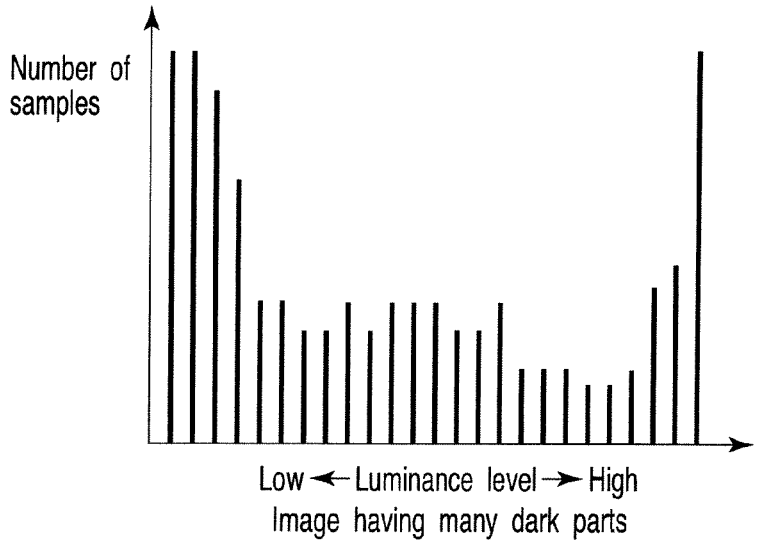
FIG. 5A is an exemplary diagram showing the histogram distribution of an example of the image.
Figure 5B:
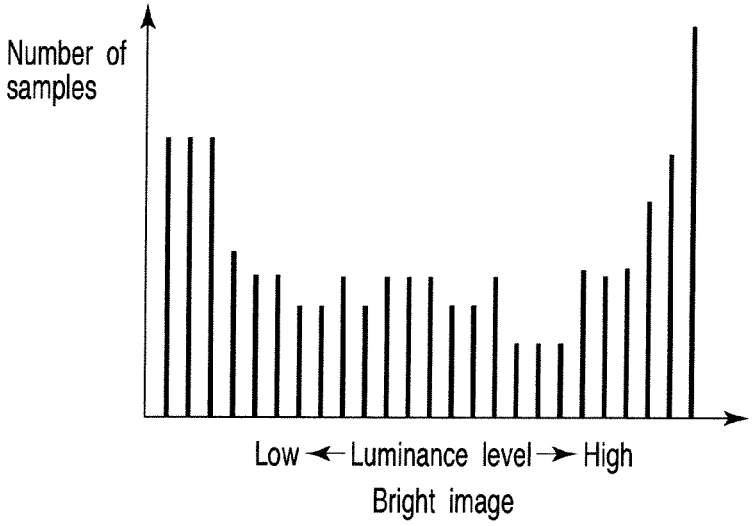
FIG. 5B is an exemplary diagram showing the histogram distribution of another example of the image.

FIGS. 5A and 5B show the histogram distributions of two images as examples, respectively. FIG. 5A indicates the characteristic of a video signal representing one frame (or one field) of an image as an example that is dark as a whole but has some bright parts. FIG. 5B indicates the characteristic of a video signal representing one frame (or one field) of an image as an example that is bright as a whole and has very bright parts.

From the histogram distribution data described above, it can be determined whether the image represented by the video signal is dark or bright as a whole. In the television broadcast receiver 11, the input/output characteristic of any video signal input is controlled.

Figure 6:
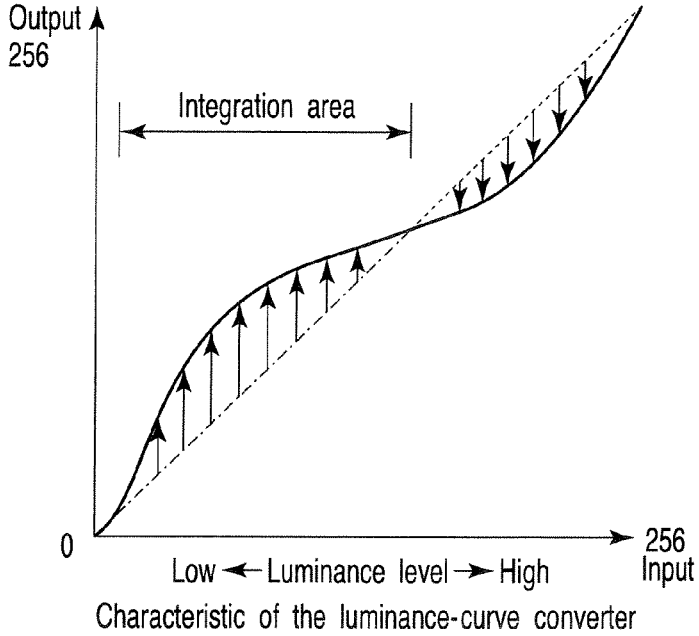
FIG. 6 is an exemplary diagram explaining an example of the conversion characteristic of the luminance-curve converter shown in FIG. 3.

FIG. 6 is a diagram explaining the input/output characteristic of the luminance-curve converter 34*a*. As seen from FIG. 6, the output signal of the converter 34*a* is emphasized if the input signal has a low luminance level. (That is, the output signal is emphasized if the image represented by the input signal is dark.) If the input signal has a high luminance level, the output signal of the converter 34*a* is suppressed. (That is, the output signal is suppressed if the image represented by the input signal is bright.) In the conventional TV broadcast receiver, the input/output characteristic changes linearly as indicated by the dashed line in FIG. 6. In the television broadcast receiver 11, the input/output characteristic changes nonlinearly as indicated by the full line in FIG. 6, emphasizing the output signal in the low-luminance region and to suppressing the output signal in the high-luminance region.

As a result, a dark image looks bright on the display 14 because the signal representing it is emphasized in terms of luminance level. This enhances the gradation of any dark region of the image. Thus, for example, black hair on a dark background, which cannot be seen unless signal is emphasized, can be recognized. However, the dark region of the image may be too conspicuous (or outstanding from the other regions). In this case, the backlight 14*b* is controlled, emitting less light, whereby the image looks rather dark as a whole, rendering the dark region less conspicuous. This helps to reduce the power consumption.

The input data and output data of the luminance-curve converter 34*a* are supplied to the integrator 35*h*. The integrator 35*h* integrates the data about the emphasized region in a dark image (FIG. 6). More precisely, the integrator 35*h* subtracts the input data of the converter 34*a* from the output data thereof and then accumulates the resulting difference, thereby obtaining the integrated value. The output of the integrator 35*h* (i.e., integrated value) is input to the multiplier 35*i*. The multiplier 35*i* multiplies the integrated value data by a coefficient, adjusting the gain. The gain thus adjusted is output as control voltage to the power-supply circuit 14*c* of the display 14.

The dark region of the image may therefore become conspicuous (or outstanding from the other regions). Thus, the backlight 14*b* is controlled, emitting less light, whereby the image looks rather dark as a whole and the dark region is rendered less conspicuous. The power consumption is thereby reduced.

Figure 7:
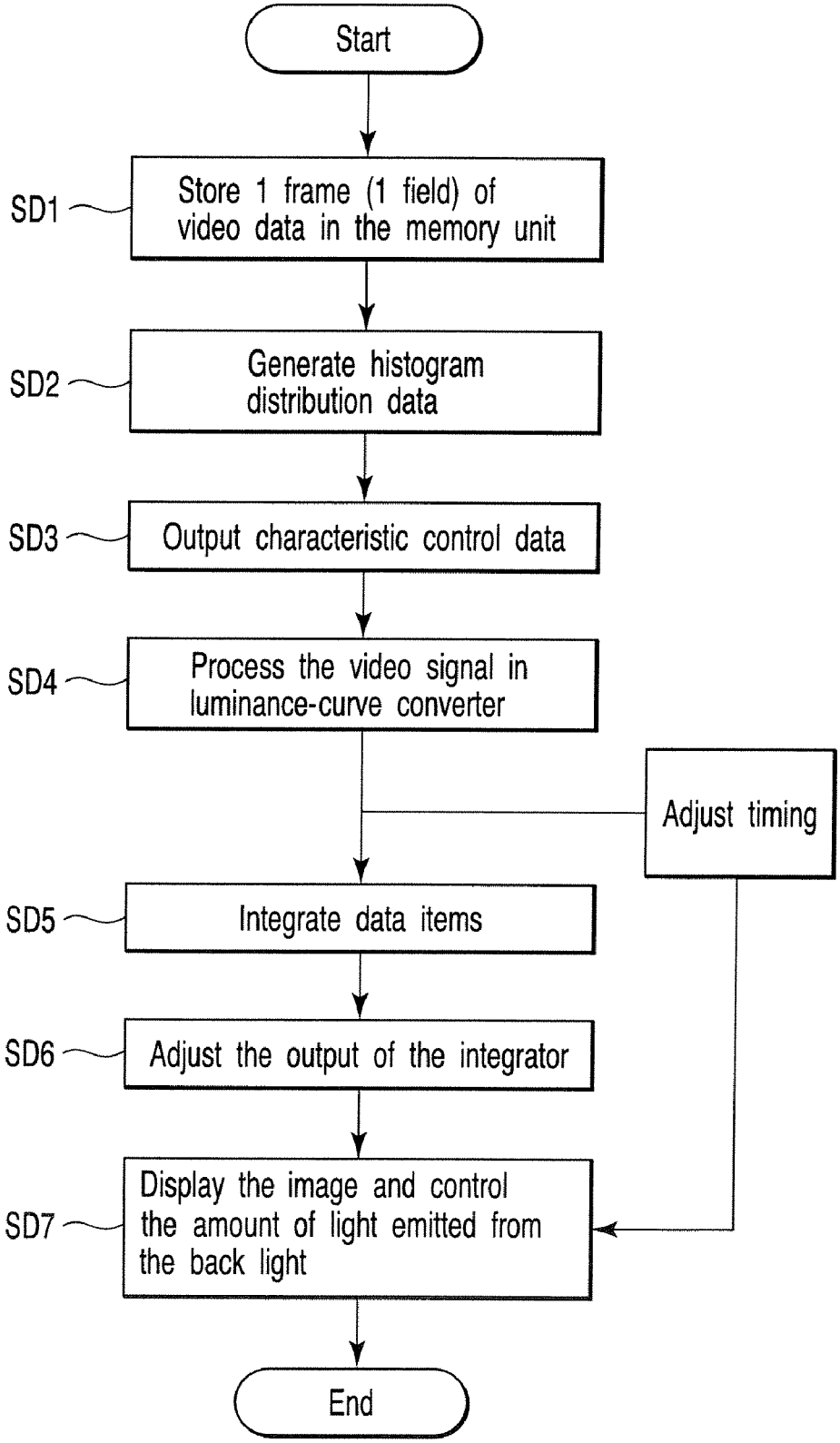
FIG. 7 is an exemplary flowchart showing how the television broadcast receiver shown in FIG. 1 operates in the embodiment.

FIG. 7 is a flowchart showing how the television broadcast receiver 11 operates in this embodiment. The memory unit 36 stores one frame (or one field) of the video signal output from the signal-processing unit 34 (Block SD1). Histogram distribution data is generated (Block SD2). The characteristic-control-data output unit 35*g* generates characteristic control data from the histogram distribution data thus generated (Block SD3). Using the characteristic control data, the luminance-curve converter 34*a* processes the input video signal (Block SD4).

The integrator 35*h* integrates the data items about those of the dark regions, which have been emphasized in luminance (Block SD5). The multiplier 35*i* adjusts the output of the integrator 35*h* (Block SD6). At this time the video signal that has been time-adjusted is supplied to the liquid crystal panel 14*a* of the display 14, which displays the image represented by this video signal (Block SD7).

(Characteristic of Control Signal K2 Generated in Unit 35-2)

Figure 8A:
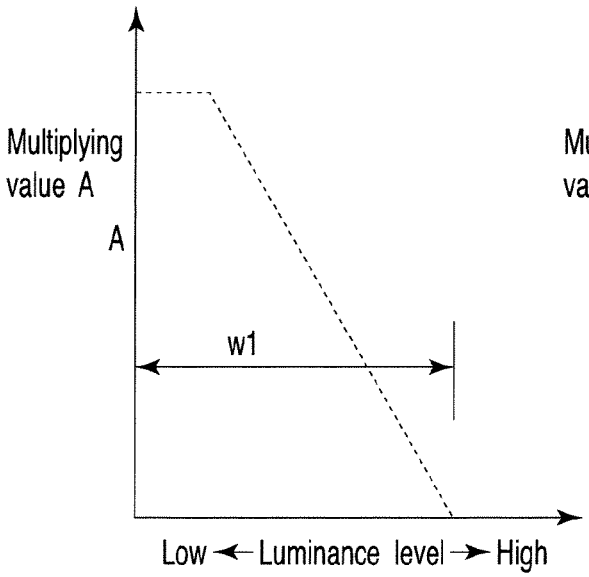
FIG. 8A is an exemplary diagram explaining how the multiplier shown in FIG. 4 multiplies a histogram distribution by multiplying values A in the embodiment.
Figure 8B:
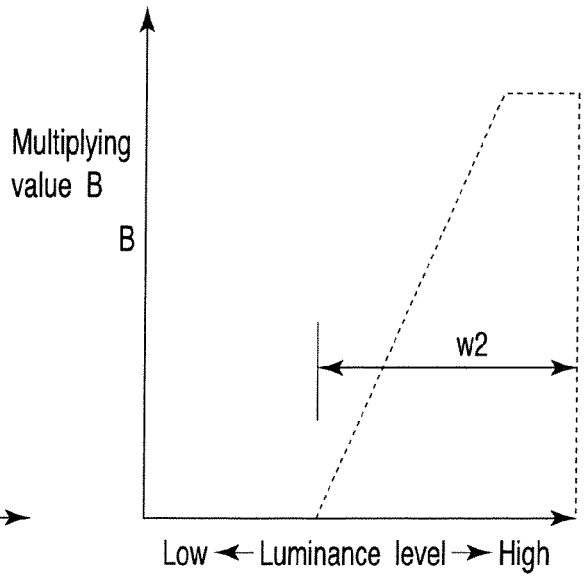
FIG. 8B is an exemplary diagram explaining how the shown in FIG. 4 multiplies a histogram distribution by multiplying values B in the embodiment.

The multiplier 35*a* has such multiplying values B as shown in FIG. 8A. The multiplier 35*b* has such multiplying values B as shown in FIG. 8B. The multiplying values A and B may be stored in the memory unit 36. The multipliers 35*a* and 35*b* multiply histogram distribution data items for the same luminance level, by values A and values B, respectively. The products that the multipliers 35*a* and 35*b* generate, each being the product of one data item and one multiplying value, are accumulated (or multiplied by one another).

Figure 9:
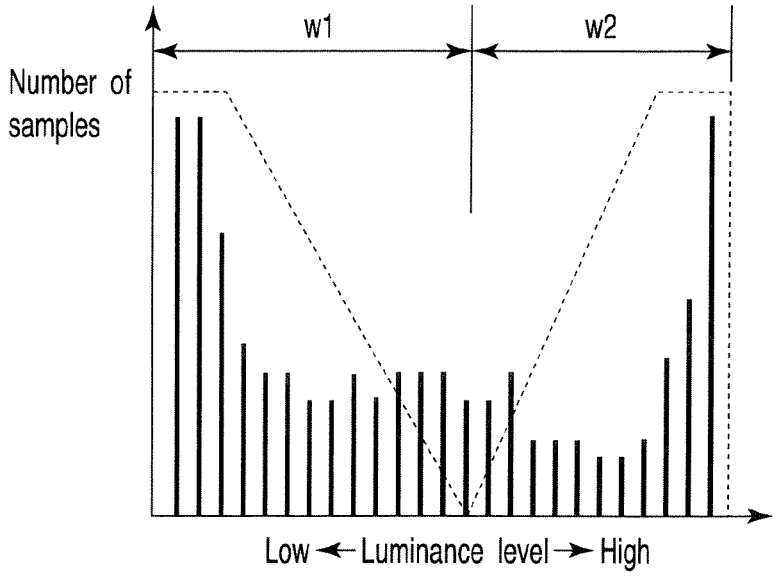
FIG. 9 is an exemplary diagram explaining how a histogram distribution is multiplied by multiplying values A and multiplying values B in the embodiment.

FIG. 9 schematically explains how the histogram distribution data is multiplied by multiplying values A (FIG. 8A) and multiplying values B (FIG. 8B). As seen from FIG. 9, two histogram distribution data items for the same luminance level are multiplied by first multiplying values A and second multiplying values B, respectively.

The range of luminance (W1) over which the multiplying values A of the first multiplier 35*a* are distributed is broader than the range of luminance (W2) over which the multiplying values B of the second multiplier 35*b* are distributed; namely, W1>W2. This is because the control unit 35 is designed to save more power for dark images than for bright images. In other words, the control unit 35 is designed on the idea that the backlight 14*b* need not emit so much light for dark images as for bright images.

As FIG. 9 shows, first multiplying values A are linearly distributed in descending order as the luminance level increases, and second multiplying values B are linearly distributed in ascending order as the luminance level increases.

Figure 10A:
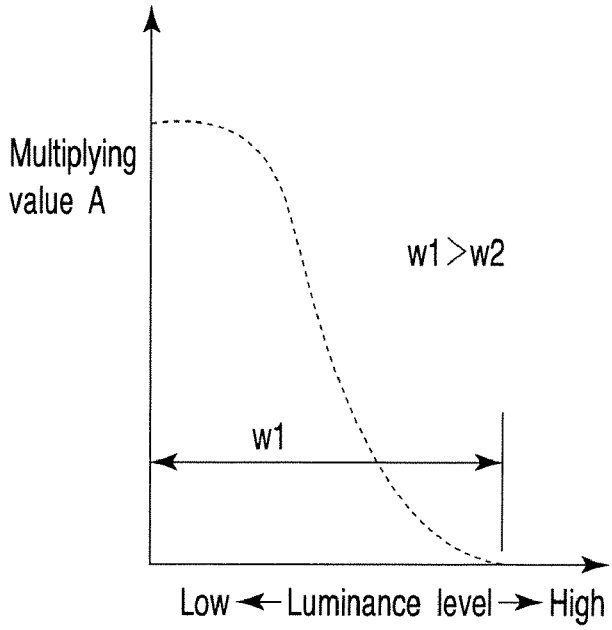
FIG. 10A is an exemplary diagram explaining how the multiplier multiplies the histogram distribution by other multiplying values A in the embodiment.
Figure 10B:
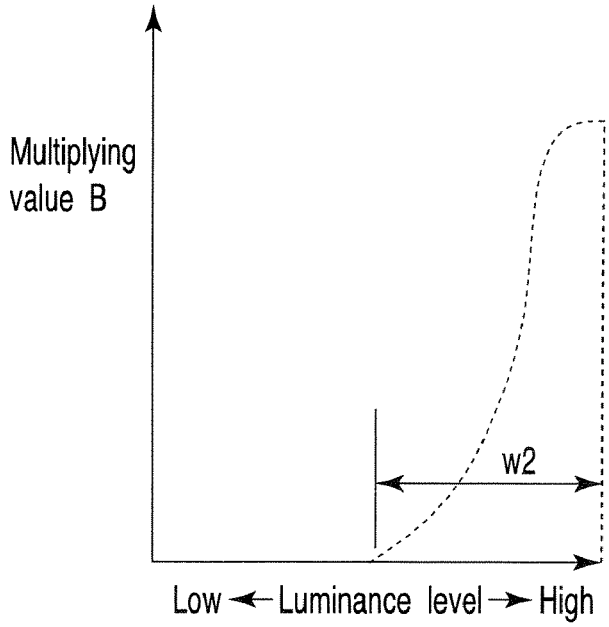
FIG. 10B is an exemplary diagram explaining how the multiplier multiplies the histogram distribution by other multiplying values B in the embodiment.

Nonetheless, the distribution of multiplying values A and B is not limited to the one illustrated in FIG. 9 in this invention. Multiplying values A of the first multiplier 35*a* may be nonlinearly distributed in descending order as the luminance level increases, as illustrated in FIG. 10A. Similarly, multiplying values B of the second multiplier 35*b* may be nonlinearly distributed in ascending order as the luminance level increases, as illustrated in FIG. 10B. In this case, too, it is desired that range of luminance (W1) over which the multiplying values A of the first multiplier 35*a* are distributed be broader than that (W2) over which the multiplying values B of the second multiplier 35*b* are distributed; namely, W1>W2.

Figure 11:
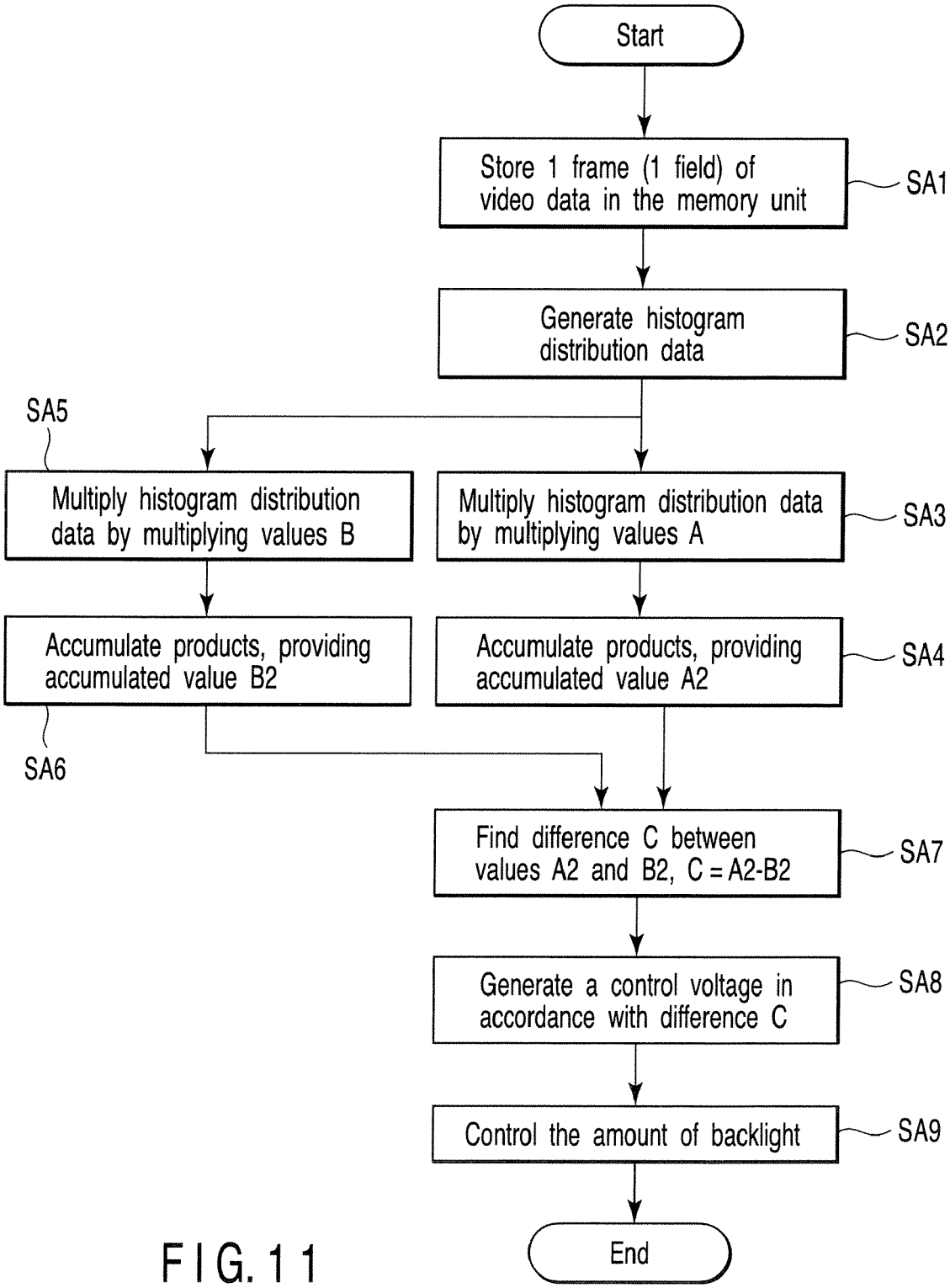
FIG. 11 is an exemplary flowchart showing how the television broadcast receiver shown in FIG. 1 operates in another way.

FIG. 11 is a flowchart showing how the television broadcast receiver 11 operates in this embodiment. The memory unit 36 stores one frame (or one field) of the video signal output from the signal-processing unit 34 (Block SA1). Histogram distribution data is generated (Block SA2). The histogram distribution data is then multiplied by multiplying values A (Block SA3). The histogram distribution data is multiplied by multiplying values B, too (Block SA5). The products generated in Block SA3 are accumulated (Block SA4), providing accumulated value A2. Similarly, the products generated in Block SA5 are accumulated (Block SA6), providing accumulated value B2.

Next, the accumulated value B2 is subtracted from the accumulated value A2, obtaining a difference C; C=A2−B2 (Block SA7). A control voltage is generated in accordance with the difference C (Block SA8). The control voltage controls the backlight 14*b* (Block SA9).

Figure 12:
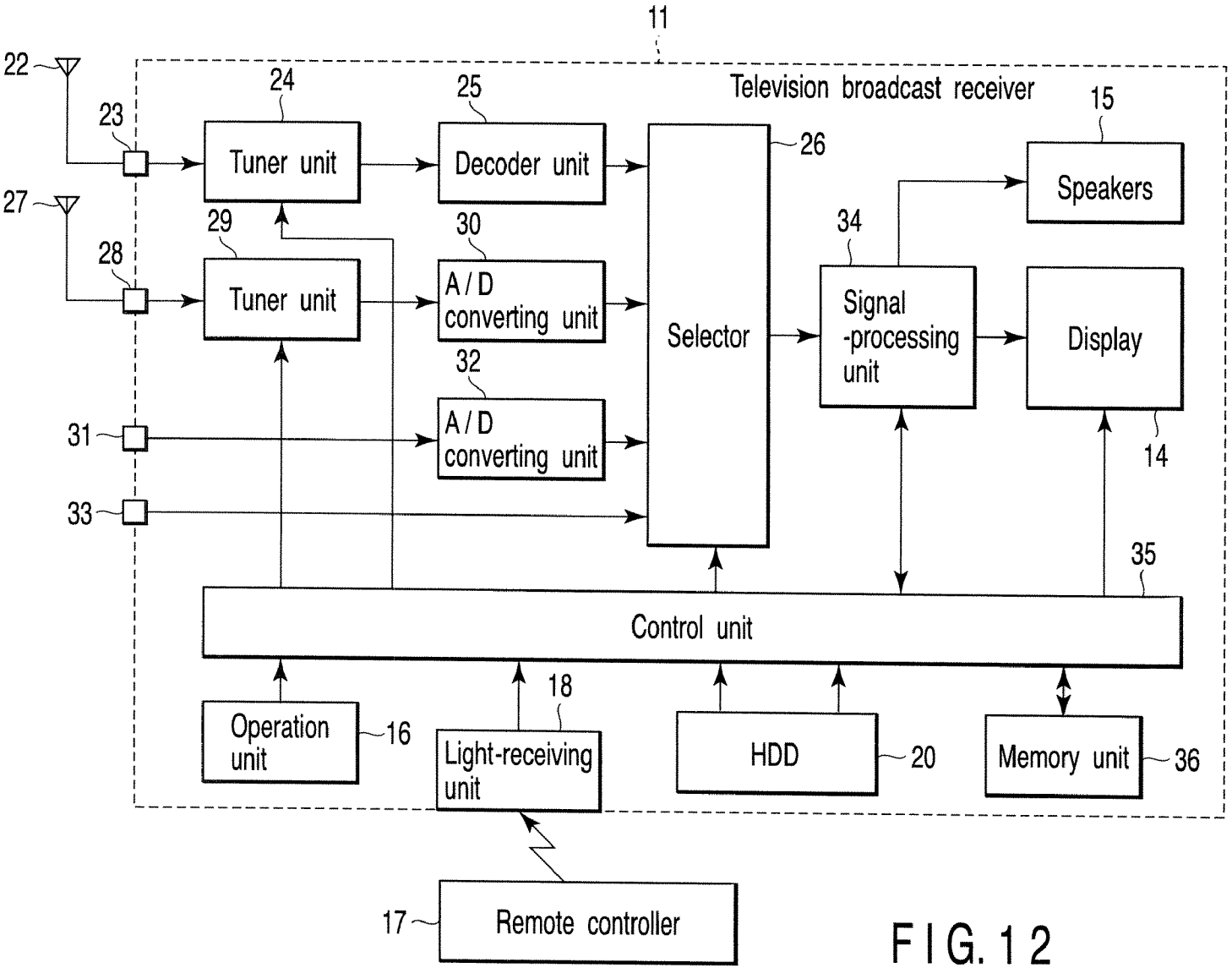
FIG. 12 is an exemplary block diagram depicting another television broadcast receiver according to an embodiment of this invention.

This invention is not limited to the embodiment described above. As seen from FIG. 2, the signal-processing system of the television broadcast receiver 11 is regarded as comprising two separate sections, i.e., cabinet 12 and stand 13. Nevertheless, the cabinet 12 and the stand 13 can be equivalently considered as a single unit in which the receiver 11 incorporates the HDD 20 as shown in FIG. 12.

While certain embodiments of the inventions have been described, these embodiments have been presented by way of example only, and are not intended to limit the scope of the inventions. Indeed, the novel methods and systems described herein may be embodied in a variety of other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. A receiving unit which receives a video signal;

a signal-processing unit which performs a specific process on the video signal received at the receiving unit;

a luminance-curve converter which converts the input/output characteristic of the luminance level of an input video signal in the signal-processing unit;

a display device which displays an image represented by the video signal that is an output of the luminance-curve converter;

a histogram-extracting unit which generates histogram distribution data for a luminance level of a video signal that is to be input to the luminance-curve converter;

characteristic-control-data output unit which sets a characteristic to the luminance-curve converter so that the converter emphasizes a low-luminance region when the histogram distribution data shows that the image represented by the input video signal includes the low-luminance region;

a first control-signal generating unit which generates a control signal that reduces the amount of light emitted from a backlight to a value corresponding to a value obtained by integrating data from a controlling part of the low-luminance region output from the luminance-curve converter;

a second control-signal generating unit which determines darkness of the image from the histogram distribution data and generates a control signal that reduces the amount of light emitted from the backlight in accordance with the darkness of the image;

and a selector which selects and outputs one of the control signals output from the first and second control-signal generating units, which reduces the amount of light emitted from the backlight.

2. The display apparatus according to claim 1, wherein the low-luminance region has a luminance level that is lower than an intermediate value between a maximum value and minimum value for the luminance level.

3. The display apparatus according to claim 1, wherein the low-luminance region includes a luminance level that is lower than an intermediate value between a maximum value and minimum value for the luminance level, and the luminance-curve converter is set to such a characteristic that an input is suppressed for a high-luminance region of the image represented by the input video signal.

4. The display apparatus according to claim 1, wherein the first control-signal generating unit includes an integrator which integrates data items pertaining to the emphasized low-luminance region of the image represented by the video signal, and a multiplier that generates, from an output of the integrator, an output for reducing the amount of light emitted from the backlight.

5. The display apparatus according to claim 1, wherein the first control-signal generating unit includes an integrator which integrates data items pertaining to the emphasized low-luminance region of the image represented by the video signal, and a multiplier which generates, from an output of the integrator, an output for reducing the amount of light emitted from the backlight, and the integrator finds a difference between the input and output of the luminance-curve converter and accumulates the difference when the output is greater than the input.

6. The display apparatus according to claim 1, wherein the second control-signal generating unit includes a first multiplier which multiplies the histogram distribution data with first multiplying values distributed in descending order as the luminance level increases, thereby generating a product;

a second multiplier which multiplies the histogram distribution data with second multiplying values distributed in ascending order as the luminance level increases, thereby generating a product, and a differentiator which finds a difference between the outputs of the first and second multipliers, generating control data that lowers a luminance-adjusting voltage of the display device in accordance with the magnitude ratio of the output from the first multiplier to the difference.

7. The display apparatus according to claim 1, wherein the second control-signal generating unit has a first multiplier which multiplies the histogram distribution data with first multiplying values distributed in descending order as the luminance level increases, thereby generating a product; a second multiplier which multiplies the histogram distribution data with second multiplying values distributed in ascending order as the luminance level increases, thereby generating a product, and a differentiator which finds a difference between the outputs of the first and second multipliers, generating control data that lowers a luminance-adjusting voltage of the display device in accordance with the magnitude ratio of the output from the first multiplier to the output of the second multiplier;

and $W1>W2$, where $W1$ is a range of luminance over which the multiplying values of the first multiplier are distributed in descending order as the luminance level increases, and $W2$ is a range of luminance over which the multiplying values of the second multiplier are distributed in ascending order as the luminance level increases.

8. The display apparatus according to claim 1, wherein the second control-signal generating unit has a first multiplier which multiplies the histogram distribution data by multiplying values distributed with respect to the luminance level, thereby generating a product; a second multiplier which multiplies the histogram distribution data by multiplying values distributed with respect to the luminance level, thereby generating a product, and a differentiator which finds a difference between the outputs of the first and second multipliers, generating control data that lowers a luminance-adjusting voltage of the display device in accordance with the magnitude ratio of the output from the first multiplier to the output of the second multiplier;

and the multiplying values of the first multiplier are linearly distributed in descending order as the luminance level increases, and the multiplying values of the second multiplier are linearly distributed in ascending order as the luminance level increases.

9. The display apparatus according to claim 1, wherein the second control-signal generating unit has a first multiplier which multiplies the histogram distribution data with first multiplying values distributed in descending order as the luminance level increases, thereby generating a product;

a second multiplier which multiplies the histogram distribution data with second multiplying values distributed in ascending order as the luminance level increases, thereby generating a product, and a differentiator which finds a difference between the outputs of the first and second multipliers, generating control data that lowers a luminance-adjusting voltage of the display device in accordance with the magnitude ratio of the output from the first multiplier to the output of the second multiplier;

the multiplying values of the first multiplier are nonlinearly distributed in descending order as the luminance level increases, and the multiplying values of the second multiplier are nonlinearly distributed in ascending order as the luminance level increases;

and W1>W2, where W1 is a range of luminance over which the multiplying values of the first multiplier are distributed in descending order as the luminance level increases, and W2 is a range over which the multiplying values of the second multiplier are distributed in ascending order as the luminance level increases.

10. The display apparatus according to claim 1, wherein an output of the selector controls a power-supply voltage of the backlight provided in the display device, thereby to reduce the amount of light emitted from the backlight.

11. A method of controlling a backlight for use in a display apparatus comprising a receiving unit which receives a video signal, a signal-processing unit which performs a specific process on the video signal received at the receiving unit, a luminance-curve converter which converts the input/output characteristic of the luminance level of an input video signal in the signal-processing unit, a display device which displays an image represented by the video signal that is an output of the luminance-curve converter, and a control unit which controls the other components of the display apparatus, said method comprising:

generating histogram distribution data for a luminance level of a video signal that is to be input to the luminance-curve converter;

setting a characteristic to the luminance-curve converter so that the converter emphasizes a low-luminance region when the histogram distribution data shows that the image represented by the input video signal includes the low-luminance region;

generating a first control signal that reduces the amount of light emitted from the backlight to a value corresponding to a value obtained by integrating data from a controlling part of the low-luminance region output from the luminance-curve converter;

determining determines darkness of the image from the histogram distribution data and generating a second control signal that reduces the amount of light emitted from the backlight in accordance with the darkness of the image;

and selecting and outputting one of the first and second control signals, which reduces the amount of light emitted from the backlight.

* * * * *